US005437399A

United States Patent [19]

Levitt et al.

[11] Patent Number: 5,437,399

[45] Date of Patent: * Aug. 1, 1995

[54] DEVICE FOR HOLDING WRITING INSTRUMENTS

[76] Inventors: Michael Levitt, 34-05 Woodward St.; Gregory Gelman, 33-29 Poplar St., both of Oceanside, N.Y. 11572

[ * ] Notice: The portion of the term of this patent subsequent to Mar. 1, 2011 has been disclaimed.

[21] Appl. No.: 177,475

[22] Filed: Feb. 23, 1994

Related U.S. Application Data

[63] Continuation-in-part of Ser. No. 838,025, Feb. 20, 1992, Pat. No. 5,289,961.

[51] Int. Cl.[6] ..... A45F 5/00

[52] U.S. Cl. ..... 224/247; 224/219; 224/222; 224/269

[58] Field of Search ..... 224/217, 218, 219, 222, 224/224, 230, 231, 232, 233, 247, 248, 268, 267, 269, 271, 904, 901; 2/250, 251, 249, 254, 268; 450/86; 24/6, 10 R, 11 CC, 11 HC, 11 S

[56] References Cited

U.S. PATENT DOCUMENTS

| | | | |
|---|---|---|---|
| 1,274,312 | 7/1918 | Nicoll | 224/222 |
| 1,833,222 | 11/1931 | Lischeid | 224/230 X |
| 3,273,766 | 9/1966 | Cosentino | 224/219 X |
| 3,401,529 | 9/1968 | Fifield | 224/247 X |
| 5,056,661 | 10/1991 | Balzano | 224/247 X |
| 5,289,961 | 3/1994 | Levitt et al. | 224/247 |

*Primary Examiner*—Robert M. Fetsuga
*Assistant Examiner*—Steven O. Douglas
*Attorney, Agent, or Firm*—Ilya Zborovsky

[57] ABSTRACT

A device for holding writing instruments has an elongated supporting member having a predetermined direction of elongation, a plurality of holding members arranged on the supporting member substantially side-by-side along the direction of elongation of the supporting member and each having at least one receptacle for receiving at least one writing instrument, each of the receptacles being elastically expandable so that a writing instrument can be introduced in the receptacle and then contractible so as to reliably retain the introduced writing instrument in the receptacle upon the contraction of the receptacle, the holding members being spaced from one another by a distance which is smaller than a size of each of the receptacles in the expanded position as considered in the direction of elongation of the supporting member, so that a writing instrument can be inserted into the receptacles but cannot be inserted into a space between the holding members.

10 Claims, 2 Drawing Sheets

DEVICE FOR HOLDING WRITING INSTRUMENTS

CROSS REFERENCE TO RELATED APPLICATION

This application is a continuation-in-part of U.S. patent application Ser. No. 07/838,025 filed on Feb. 20, 1992, now U.S. Pat. No. 5,289,961.

BACKGROUND OF THE INVENTION

The present invention relates to a device for holding writing instruments, in particular during performing some works which require movements of a user which can result in falling out of writing instruments.

During performing some works, for example construction, repair, etc. a worker moves to respective positions to perform respective steps of the works. Writing instruments, such as pencils, pens, markers and the like are usually held in a pocket, behind his ear, in his hair, etc. During the above specified movements they can fall out and get lost or must be again located and put back with corresponding waste of time. It is therefore believed to be clear that it is desirable to develop a way to reliably retain writing instruments on a part of body or clothes of a worker, so that during performance of works they do not fall out in unauthorized manner but at the same time can be easily removed by a user to be used for respective operations.

Some devices for holding various objects are disclosed in U.S. Pat. Nos. 1,274,312; 1,833,222; 3,273,766; 3,401,529; 5,056,661. However, these devices have several disadvantages and can be further improved for holding writing instruments.

SUMMARY OF THE INVENTION

Accordingly, it is an object of the present invention to provide a device for holding writing instruments which can hold writing instruments so that their unauthorized falling out is prevented and at the same time they can be easily removed from the device for respective operations.

In keeping with these objects and with others which will become apparent hereinafter, one feature of the present invention resides, briefly stated, in a device for holding writing instruments which has an elongated supporting member having a predetermined direction of elongation; a plurality of holding members arranged on the supporting member substantially side-by-side along the direction of elongation of the supporting member and each having at least one receptacle for receiving at least one writing instrument, each of the receptacles being elastically expandable so that a writing instrument can be introduced in the receptacle and then contractible so as to reliably retain the introduced writing instrument in the receptacle upon the contraction of the receptacle, the holding members being spaced from one another by a distance which is smaller than a size of each of the receptacles in the expanded position as considered in the direction of elongation of the supporting member, so that a writing instrument can be inserted into the receptacles but cannot be inserted into a space between the holding members.

When the device is designed in accordance with the present invention, it reliably holds the writing instruments with simultaneously allowing their easy withdrawal from the device for respective operations. At the same time, the inventive device provides for highly advantageous results. In particular, when the distances between the holding members is smaller than the size of the receptacle of the holding members in the expanded position of the receptacle, writing instruments cannot be inserted in the spaces between the holding members in which they cannot be reliably retained and can be unintentionally lost. Instead they can be inserted only into the receptacles of the holding members in which they can be reliably held. Because of this, the user do not have to pay attention to the device during insertion of the writing instruments into it, instead of paying attention to its main construction works, its frequently dangerous position high above the ground and other complicated aspects of this work. The user does not have to even take a brief glance on the device in order to insert the writing instrument into the device after the use of the instrument. In whatever area of the device he makes an attempt to push the writing instrument back into the device, the writing instrument cannot be inserted between the holding members with the danger of being lost, since the distance between the holding members is smaller than the transverse size of the receptacle in the expanded position. The writing instrument cannot fit into the space between the holding members and therefore cannot be inserted into the space. When the writing instrument is pushed onto the device, the corresponding receptacle expands and it is moved into the receptacle and closely held there.

The novel features which are considered as characteristic for the invention are set forth in particular in the appended claims. The invention itself, however, both as to its construction and its method of operation, together with additional objects and advantages thereof, will be best understood from the following description of preferred embodiments which is accompanied by the following drawings.

DESCRIPTION OF THE PREFERRED EMBODIMENTS

Figure 1:
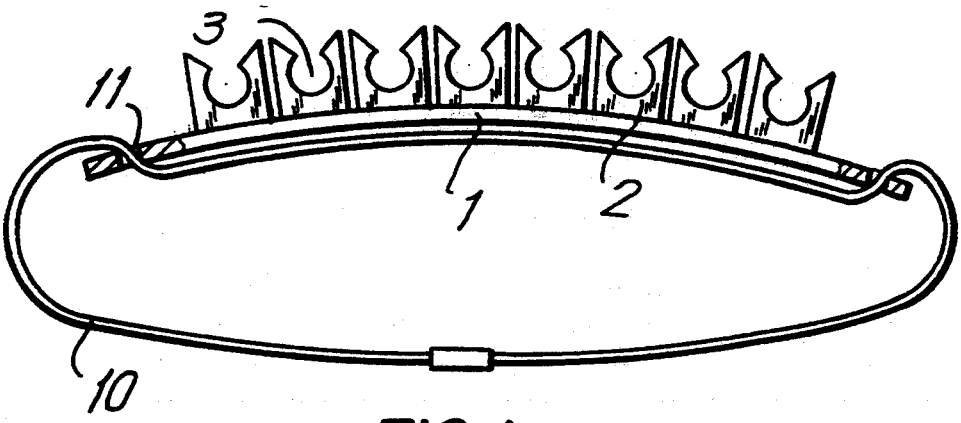
FIG. 1 is a side view showing a device for holding writing instruments in accordance with the present invention.
Figure 2:
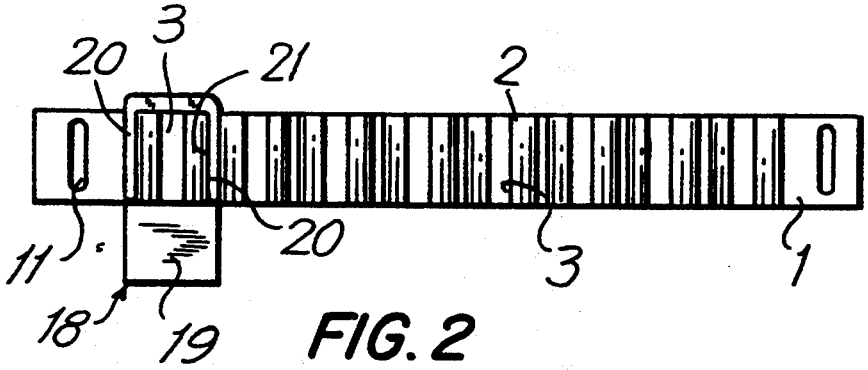
FIG. 2 is a plan view of the device in accordance with the invention.
Figure 3:
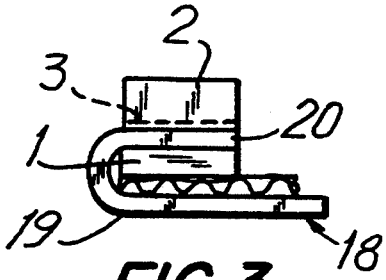
FIG. 3 is an end view of the device in accordance with the invention.

A device for holding writing instruments in accordance with the present invention has a supporting member which is identified with reference numeral 1 and a plurality of holding members which are supported by the supporting member and identified as 2. The supporting member 1 and the holding members 2 can be formed integrally of one piece with one another so as to form an integral element as shown in FIGS. 1–3. Each holding member 2 has a receptacle 3. The receptacle 3 extends in a direction which is transverse to the direction of elongation of the supporting member.

Each receptacle has an inner part for receiving and holding a writing instrument and an outer part for introducing the writing instrument into the inner part. The inner and outer parts are identified as 5 and 6. The outer part is narrower than the inner part and is formed by shoulder 7 provided in the holding member.

The holding members 2 are expandable and contractible. In one embodiment they can be composed of synthetic plastic material and formed of one piece with the supporting member 1 so as to be elastically connected with the supporting member. Therefore the walls of each of the holding members can be elastically displaceable in the direction of elongation of the supporting member. When a writing instrument is first introduced into the outer part of the holding member and then pushed downwardly into the inner part, it expands the holding member by pushing the shoulders 7 in opposite transverse directions so that a distance between the shoulders is increased, and then is inserted in the inner part of the holding member. Upon its insertion the holding member contracts back and the distance between the shoulders 7 is reduced so that the shoulders reliably hold the writing instrument into the inner part of the receptacle.

In accordance with an important feature of the present invention, the distances between the holding members 2 are smaller than the transverse size of the receptacle in a direction of elongation of the supporting member in the expanded position of the holding member, or in other words, when the distance between the shoulders of the holding member in the expanded position. Therefore, the writing instruments cannot be introduced into the spaces between the holding members in which there is nothing to retain them there, but instead can be introduced only into the holding members.

As can be seen from the drawings, each holding member has two lateral straight sides extending from the supporting member, the outer part of each holding member is formed by two inclined surfaces converging downwardly toward the inner part, and the inner part is formed by a partially circular surface so that the shoulders 7 are formed between the inclined surfaces of the outer part and the partially circular surface of the inner part. When the inclined surfaces of the outer part diverge upwardly in a direction away from the inner part, they are connected with the side surfaces of the holding member. Each inclined surface forms an acute angle with each side surface of the holding member. Two inclined surfaces of the two holding members located near one another form a kind of a tip. When the writing instrument is pushed onto the device and meets with the thusly formed tip, it can slide over any of the inclined surfaces of the neighboring holding members into any of the holding members.

It is believed to be clear that while the writing instruments are reliably retained in the holding members or their receptacles formed by the inner and outer parts, they can be easily withdrawn by a user by overcoming the resistance of the shoulders. When a writing instrument is pulled from the corresponding holding member, the holding member is expanded since the writing instrument presses against the shoulders, spreads them apart and the walls of the holding member deflect in opposite directions in the direction of elongation of the supporting member.

Figure 4:
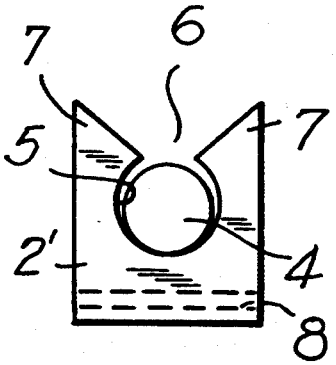
FIGS. 4 and 5 are a side view and an end view of a holding member of the inventive device.
Figure 5:
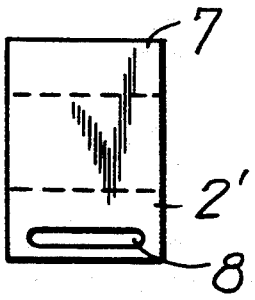
Figure 6:
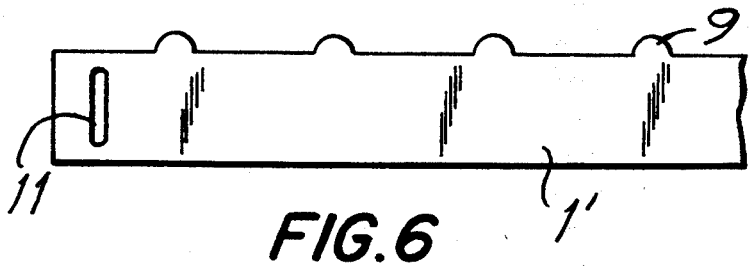
FIG. 6 is a view showing a supporting member of the device of the invention.

In the embodiment of FIGS. 4–6 a supporting member 1' and holding members 2' are formed as separate elements. Each holding member has an opening 8 which extends substantially transversely to the receptacle 3 and formed as a slot which is elongated in the direction of the receptacle. By the slots, the holding members can be fitted on the supporting member 1' one after the other. The supporting member 1' is provided with a plurality of spacing formations or projections 9 which are elastically yieldable.

Figure 7:
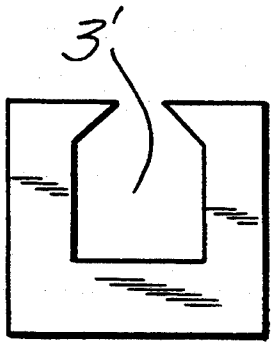
FIGS. 7 and 8 are views showing further modifications of the holding members of the inventive device.
Figure 8:
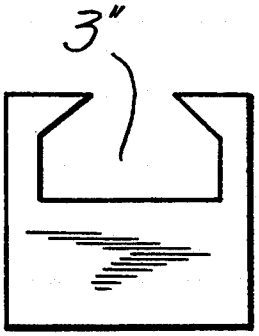

In practice there is a need to hold writing instruments of different size and/or shapes, for example pencils, pens, markers, etc. For this purpose the holding elements can have differently sized and/or shaped receptacles 3' and 3'' as shown in FIGS. 7 and 8.

In order to retain the device on a part of body or clothes, retaining means is provided. The retaining means can be formed as an adjustable belt 10 extending through end slots 11 of the supporting member and adjustable due to the provision of a plurality of openings spaced in its direction of elongation and cooperating with a buckle, as well known. The retaining means can be formed as an elastic member which is stretchable to adapt to the size of the body part over which the supporting member and the retaining member are fitted.

Figure 9:
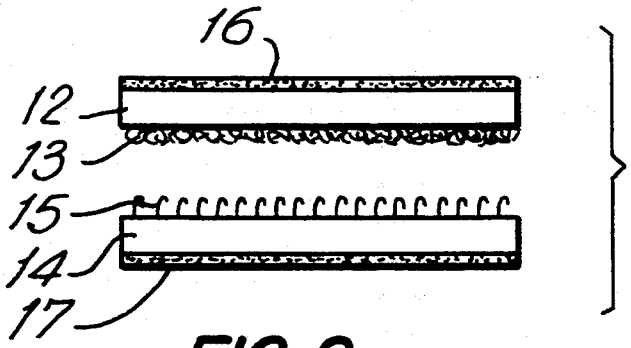
FIG. 9 is a view showing a member for retaining the device on a part of body or clothes.

Retaining means of a different construction is shown in FIG. 9. It has a member 12 attachable to a part of the clothes and having projections 13 and a member 14 attachable to the supporting member 1 and having engaging projections 15 engageable with the engaging projections 13. The member 12 can be attached to the clothes part by an adhesive layer 16 while the member 14 can be attached to the supporting member by an adhesive layer 17. The projections can be hook and loop type as well known.

Finally, the retaining means can be formed as a clip or clasp 18 provided with one leg 19, another shorter leg 20 elastically connected with the leg 19 and provided with a slot 21. The clip 18 can be fitted on the supporting member 1 so that one holding member 2 is received and clamped elastically between the legs 19 and 20, while a piece of clothes is received between the legs 19 and 20, so that the clip is reliably held on the piece and holds the device on it.

The supporting member 1, 1' can be rigid, or it can be elastic and flexible. All parts can be composed of plastic. The outer part of the receptacle 3 can also narrow outwardly as shown in FIGS. 7 and 8.

It will be understood that each of the elements described above, or two or more together, may also find a useful application in other types of constructions differing from the types described above.

While the invention has been illustrated and described as embodied in a device for holding writing instruments, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A device for holding writing instruments, comprising an elongated supporting member having a predetermined direction of elongation; a plurality of holding members arranged on said supporting member substantially side-by-side along the direction of elongation of said supporting member and each having at least one receptacle from receiving at least one writing instrument, each of said receptacles being elastically expandable so that a writing instrument can be introduced in said receptacle and then contractible so as to reliably retain the introduced writing instrument in said receptacle upon the contraction of said receptacle, said holding members being spaced from one another by a distance which is smaller than a size of each of said receptacles in the expanded position as considered in the direction of elongation of said supporting member, so that a writing instrument can be inserted into said receptacles but cannot be inserted into a space between said holding members.

2. A device for holding writing instruments as defined in claim 1, wherein each of said receptacles has an inner part which substantially receives a writing instrument and an outer outwardly open part for introducing the writing instruments into said inner part, said distance between said holding members being smaller than a size of said outer part of each of said receptacles as considered in the direction of elongation of said supporting member.

3. A device for holding writing instruments as defined in claim 2, wherein said outer part of said receptacle has two surfaces which are inclined relative to one another so as to converge in a direction toward said inner part, each of said holding members having side surfaces each forming an acute angle with a respective one of said inclined surfaces.

4. A device for holding writing instruments as defined in claim 3, wherein said inclined surfaces are arranged so that two of said inclined surfaces of two of said holding members together form substantially a tip, so that when a writing instrument meets said tip it is slideable into a respective one of said two receptacles over any of said inclined surfaces forming said tip.

5. A device for holding writing instruments as defined in claim 2, wherein each of said receptacles has a retaining shoulder provided between said inner part and said outer part so that in the expanded position of said receptacle a writing instrument can be inserted over said inner shoulder from said outer part into said inner part of said receptacle, but in the contracted position of said receptacle said shoulder retains the writing instrument in said inner part and the writing instrument cannot unintentionally fall out of said outer part.

6. A device for holding writing instruments as defined in claim 5, wherein each of said receptacles has two inner walls and two of said shoulders extending toward one another from said inner walls.

7. A device for holding writing instruments as defined in claim 1; and further comprising means for retaining said supporting member on a part of the user's body.

8. A device for holding writing instruments as defined in claim 1; and further comprising means for retaining said supporting member on a part of the user's clothes.

9. A device for holding writing instruments as defined in claim 1, wherein said elongated supporting member and said holding members together form a single one-piece element composed of a synthetic plastic material.

10. A device for holding writing instruments as defined in claim 1, wherein said holding members are elastically connected with said elongated supporting member so as to be movable between said expanded position and said contracted position.

* * * * *